US006708535B1

(12) United States Patent
Sanders

(10) Patent No.: US 6,708,535 B1
(45) Date of Patent: Mar. 23, 2004

(54) NOTEBOOK COMPUTER SECURITY HOOK LOCK ASSEMBLY

(76) Inventor: Richard Sanders, 29 Harwich Cir., Westwood, MA (US) 02090

( * ) Notice: Subject to any disclaimer, the term of this patent is extended or adjusted under 35 U.S.C. 154(b) by 0 days.

(21) Appl. No.: 10/457,331

(22) Filed: Jun. 10, 2003

(51) Int. Cl.[7] ..... E05B 69/00
(52) U.S. Cl. ..... 70/58; 70/14
(58) Field of Search ..... 70/58, 49, 14, 70/18, 57; 248/551, 553

(56) References Cited

U.S. PATENT DOCUMENTS 4,311,883 A * 1/1982 Kidney ..... 379/443
4,964,284 A * 10/1990 McDaid ..... 70/14
5,344,329 A * 9/1994 Faller ..... 439/133
5,502,989 A * 4/1996 Murray et al. ..... 70/58
5,870,281 A * 2/1999 Kim ..... 361/681
5,875,657 A * 3/1999 Kelley ..... 70/18
5,987,937 A * 11/1999 Lee ..... 70/14
6,205,824 B1 * 3/2001 Miao ..... 70/58
6,227,017 B1 * 5/2001 Igelmund ..... 70/58
6,244,080 B1 * 6/2001 Sakurai ..... 70/14
6,463,770 B1 * 10/2002 Lee ..... 70/58
6,591,642 B1 * 7/2003 Kuo ..... 70/58
6,601,416 B1 * 8/2003 Sanders ..... 70/58

* cited by examiner

*Primary Examiner*—John B. Walsh
(74) *Attorney, Agent, or Firm*—John P. McGonagle

(57) ABSTRACT

A computer lock with a locking plate and protruding hook joined to a cylindrical assembly wherein the hook is inserted into a computer chassis security slot. The locking plate interacts with grooves within the cylindrical assembly to position and hold the protruding hook longitudinally within the security slot. A lockable cable engages the cylindrical assembly. The cable is secured to a fixed object to prevent the computer from being stolen or removed from a fixed location.

10 Claims, 7 Drawing Sheets

NOTEBOOK COMPUTER SECURITY HOOK LOCK ASSEMBLY

BACKGROUND OF THE INVENTION

This invention relates to security apparatus, and more particularly to apparatus for securing notebook computer equipment.

In recent years there has been a marked increase in the amount of computer equipment used in business and at home. Not only have the number of computers increased, but their size has become steadily smaller. Computer owners carry with them and use in areas with public access smaller computers such as laptop and notebook computers. Notebook computers only weigh several pounds or less and are easily concealed on the person or in a carry bag. Equipment items in this category generally have values from one to several thousands of dollars, and are easily marketed. Equipment such as this and their component parts are, therefore, attractive, lucrative and easy targets for thieves.

Many personal computers have a security slot in an external wall. Attempts to provide securing devices centered on this slot have been complicated. An example of this may be found in U.S. Pat. No. 5,502,989 (Reexamination Certificate B1 5,502,989), issued to W. R. Murray, Jr., et al. The Murray device, inter alia, provides a security device comprised of a housing with a slot engagement portion, said portion being rotatable between an unlocked position and a locked position, and a pin coupled through the housing and extending into the security slot member after said slot engagement member is in said locked position. The Murray device is specifically designed to engage a rectangular security slot. Another approach has been used in U.S. Pat. No. 5,983,679 issued to G. Reyes. The Reyes device uses a cam assembly with a single hook arm in conjunction with two prongs to engage with the predefined rectangular security slot.

A further problem with prior art locks, is the poor fit the locks make with the security slot. Many computer manufacturers have a different thickness in the wall with the security slot. Prior art locks have a set gripping width, i.e., the distance between the lock engagement end on one side of the security slot and the lock assembly itself on the other side of the security slot. Ideally, the gripping width should be as close to the width of the computer side wall as possible to prevent easy insertion of a prying device. The user must measure the wall thickness and shop for a lock with a gripping width as close to the wall thickness as possible.

SUMMARY OF THE INVENTION

The present invention provides a relatively simple locking mechanism for preventing the theft of a small computer, such as a notebook computer. The locking mechanism of the present invention is adapted to fit all computers made by all manufacturers, which contain a security slot in their chassis, regardless of the configuration of the security slot.

To attain this, the present invention provides a lock with a locking plate and protruding hook joined to a cylindrical assembly wherein the hook is adapted to being inserted into a computer chassis security slot. The locking plate interacts with grooves within the cylindrical assembly to position and hold the protruding hook longitudinally. The present invention replaces the complications inherent with the removable coupling pin of the Murray invention and eliminates the need for rotating the entire assembly in order to be positioned with a locked position. The present invention provides a sturdier and simpler locking configuration than the Reyes device. The unique design of the present invention makes the present invention an ideal choice for the individual or organization that has a variety of computer brands to secure. A lockable cable engages the cylindrical assembly. The cable is secured to a fixed object to prevent the computer from being stolen or removed from a fixed location. In the present invention a variety of different type locking cables may be used.

The present invention provides a means for adjusting, both manually and automatically, the gripping width of the present invention lock assembly. Regardless of the thickness of the computer wall having the security slot, the present invention can be adjusted to provide a perfect gripping width. To the best of applicant's knowledge, the present invention is the only lock which has this feature.

Accordingly, it is an object of the present invention to provide a computer security locking apparatus for securing small computers, such as notebook computers, which have security slots in their chassis. It is additionally an object of the present invention to provide such an apparatus which is simple, economical, easy to use and quickly installed.

Another object of the invention is to provide such a security apparatus which is installed to said computer without modifying the computer chassis thereby removing the risk of contacting various components and circuitry therewithin.

It is another object of the present invention to provide a security apparatus which may use different types of anchoring cables.

It is an object of the invention to provide a security apparatus which does not require rotation between locked and unlocked positions.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
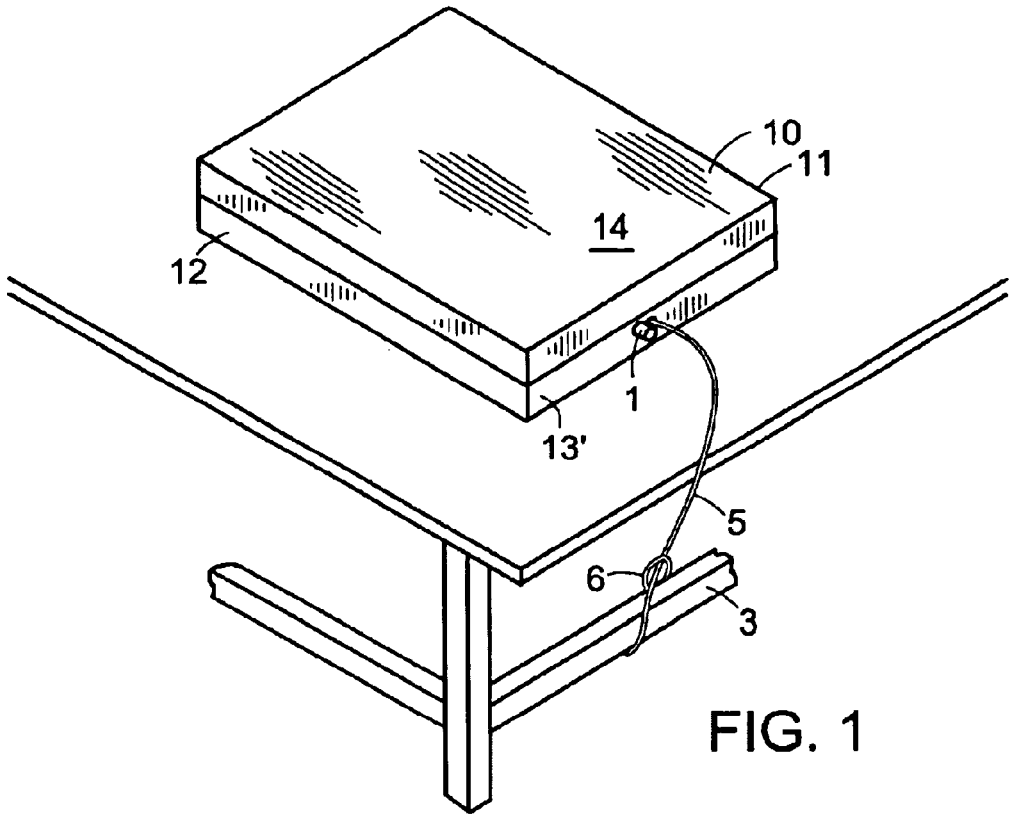
FIG. 1 is a perspective view of the invention, with a travel anchor cable, installed on a notebook computer, thereby securing the notebook computer to a table.

Referring to the drawings in detail wherein like elements are indicated by like numerals, there is shown an embodiment of a notebook computer security hook lock assembly 1 constructed according to the principles of the present invention. The invention 1 provides lock body 40 containing a lock cylinder 20 with an attached protruding hook element 25. The lock body 40, itself, is housed within a cable lock housing 80. An anchored locking cable 5 is removably attached to the cable lock housing 80. In the examples shown, the computer 10 is a notebook computer. The computer 10 secured could be a smaller or a larger personal computer.

The computer 10 has a generally rectangular configuration, with a front outer wall 11, rear outer wall 12, two outer side walls 13, a top 14, and a bottom 15. One of the computer sides 13' has an open, generally rectangular, security slot 16 formed therein. The security slot has two long edges 17 defining a security slot longitudinal axis, and two short edges 18. In this embodiment, the security slot short edges 18 are parallel to the computer chassis top 14 and bottom 15. The invention protruding hook element 25 is insertable into the open security slot 16. Manipulation of the lock cylinder 20 locks the lock cylinder 20 and lock body 40 to the computer 10. The cable lock housing 80 encloses the lock body 40. The locking cable 5 is joined to the cable lock housing 80 and is fastened to an appropriate secure object such as a table leg 3.

The lock cylinder 20 is a conventional key 2 operated lock with internal indents (not shown) to hold a key rotational turn at either a radial 0 degrees or a radial 90 degrees. The lock cylinder 20 has a rear portion 21 adapted to receive a key 2, an opposite and parallel forward portion 22 and a cylindrical body 23 extending from said rear portion 21 and terminating in said forward portion 22, said rear 21 and forward 22 portions defining a lock cylinder longitudinal axis. The lock cylinder body 23 has an elongated channel 37 formed therein, beginning at the lock cylinder rear portion 21 and extending forwardly a desired distance, said channel 37 having a longitudinal axis coincident with the lock cylinder longitudinal axis. The lock cylinder forward portion 22 has a central, threaded aperture 24 formed therein.

A generally flat and generally rectangular locking plate 30 is fixedly attached to the lock cylinder forward portion 22. The locking plate 30 has a flat plane parallel to a radial plane of the lock cylinder cylindrical body 23. The locking plate 30 has a forward surface 31, a rearward surface 32, two parallel long side edges 33, two parallel short side edges 34, and a central aperture 35 corresponding to the lock cylinder forward portion aperture 24. The locking plate rearward surface 32 is attached to the lock cylinder forward portion 22. The locking plate short side edges 34 define a locking plate longitudinal axis which is parallel to the locking plate long side edges 33 and which is transverse to the longitudinal axis of the lock cylinder 20. The locking plate long side edges 33 exceed a lock cylinder cylindrical body radial diameter. The lock cylinder 22 is adapted so that movement of the key 2 to and from 0 degrees through 90 degrees causes a direct corresponding turn of the locking plate 30 longitudinal axis about the locking plate central aperture 35.

The present invention is further comprised of a protruding hook element 25 attached to the lock cylinder forward portion 22. The hook element 25 has a front end 26 and a rear end 27 terminating in a threaded element 28 extending rearwardly from the hook element rear end 27. The hook element front end 26 is bent at an obtuse angle thereby forming an obtuse hook. The hook element threaded element 28 is adapted to threadingly engage the lock cylinder forward portion central threaded aperture 24 through the locking plate central aperture 35. A compression spring 29 is fitted over the hook element 25.

Figure 6:
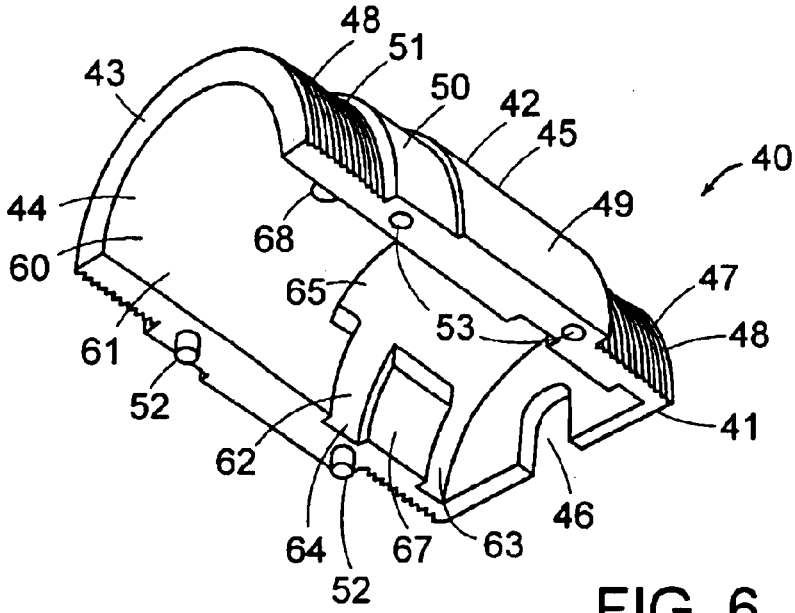
FIG. 6 is a perspective view of the upper half of a lock body.
Figure 7:
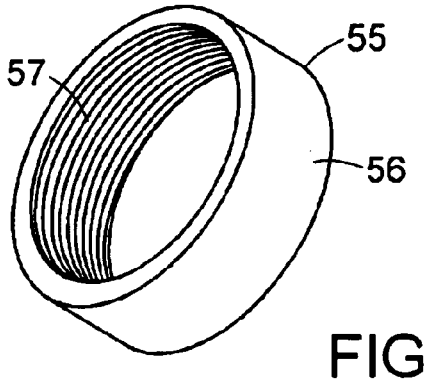
FIG. 7 is a perspective view of a ring used on the lock body.
Figure 8:
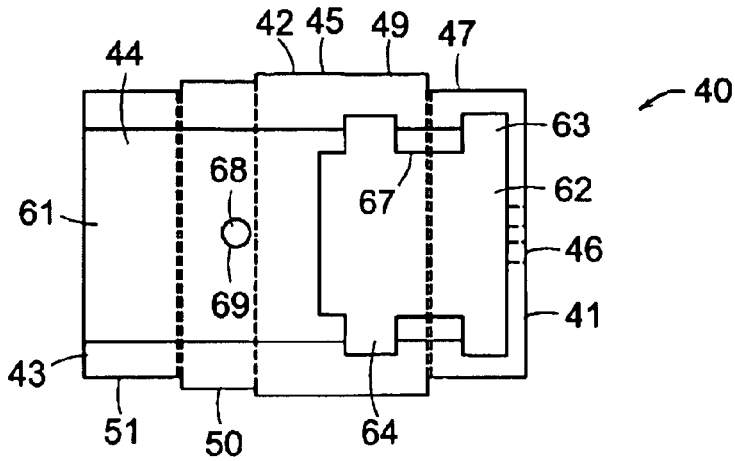
FIG. 8 is a side cross section view of the lock body.
Figure 9:
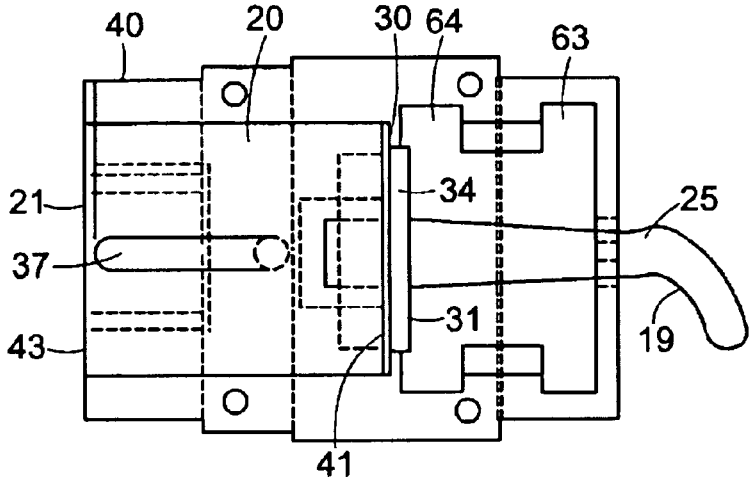
FIG. 9 is a side cross section view of a disengaged lock body with lock cylinder.
Figure 10:
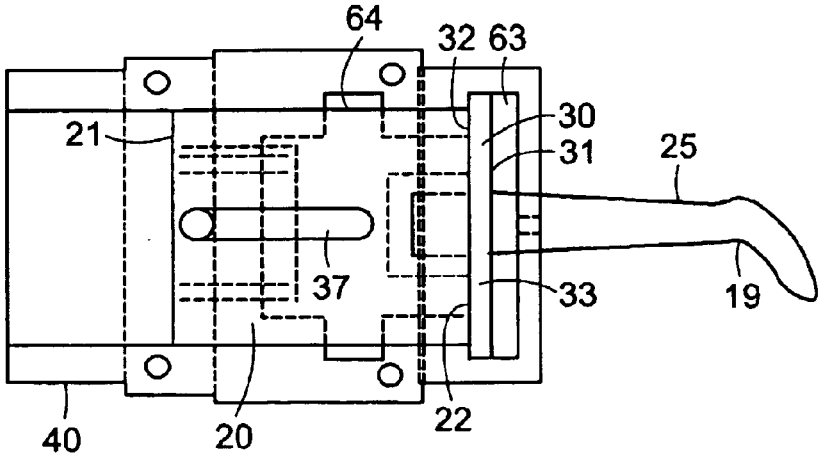
FIG. 10 is a side cross section view of an engaged for installation lock body with lock cylinder.
Figure 11:
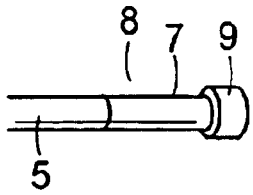
FIG. 11 is a side view of one end of the holding end of an anchor cable.
Figure 12:
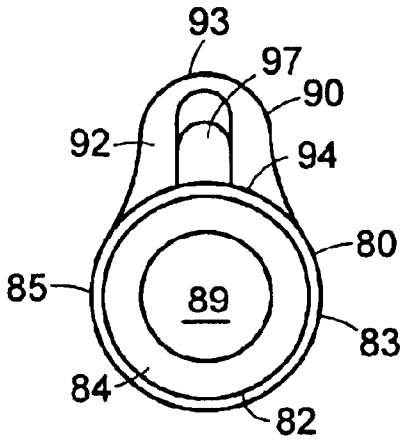
FIG. 12 is a rear view of the lock housing.
Figure 13:
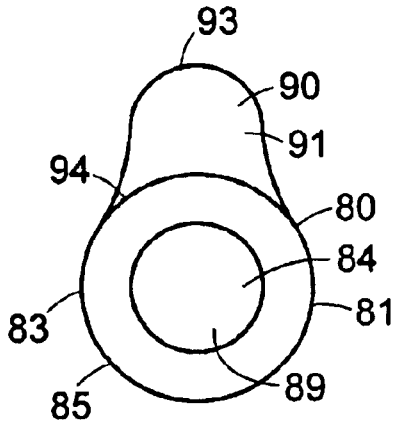
FIG. 13 is a front view of the lock housing.
Figure 14:
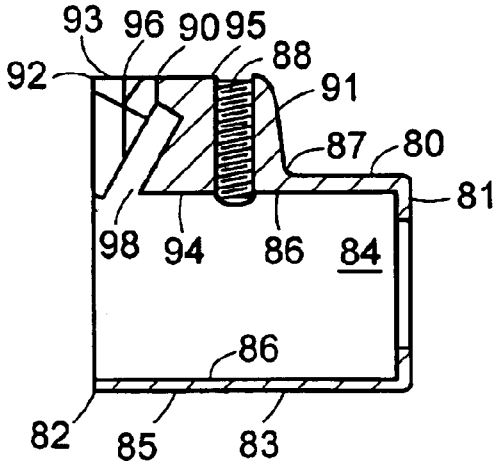
FIG. 14 is a cross section view of the lock housing.
Figure 15:
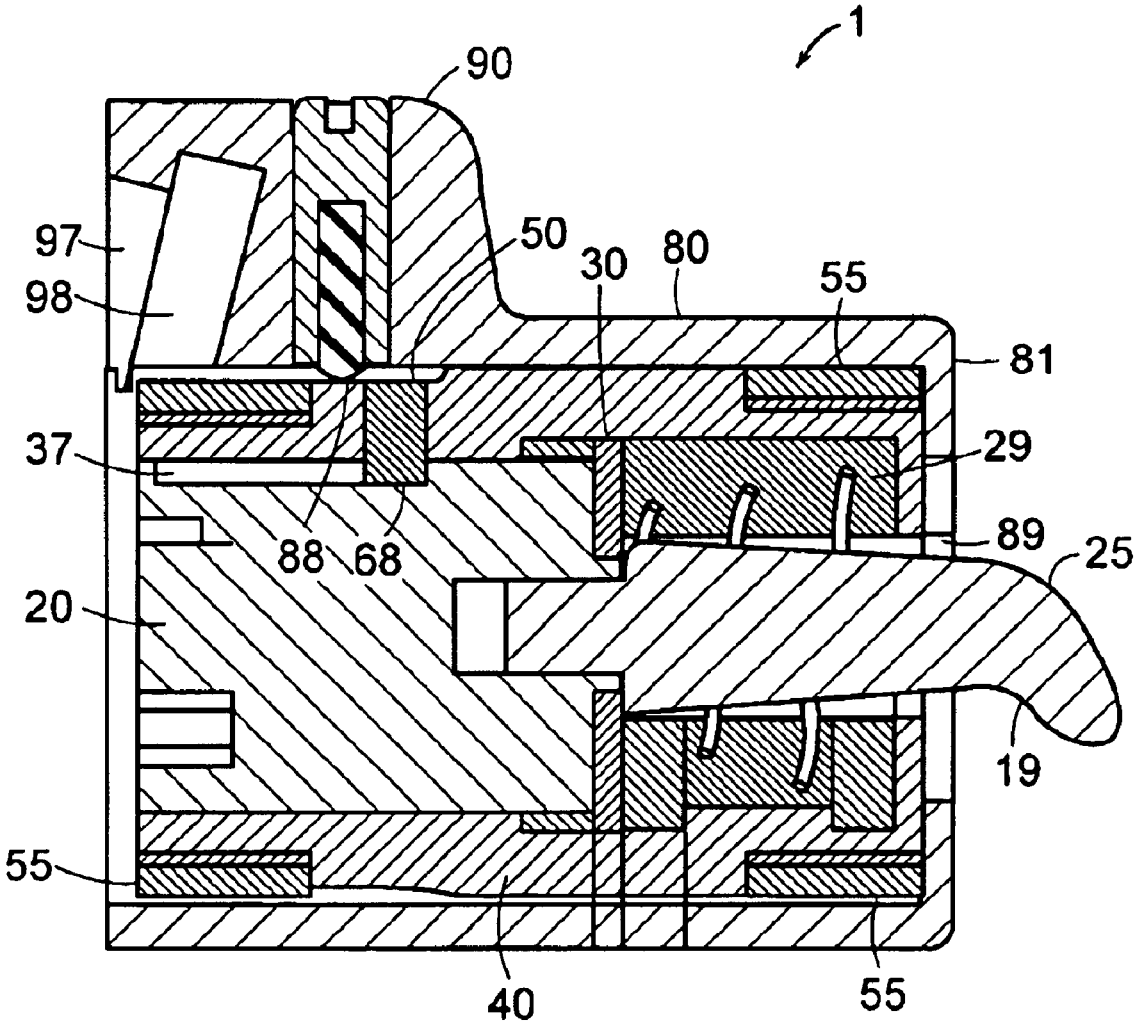
FIG. 15 is a sectional side view of the invention.
Figure 16:
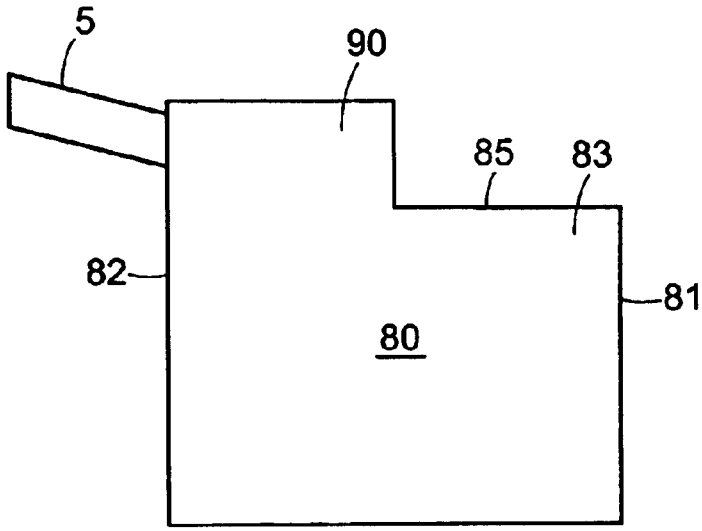
FIG. 16 is a diagramatic side view of the lock housing.
Figure 17:
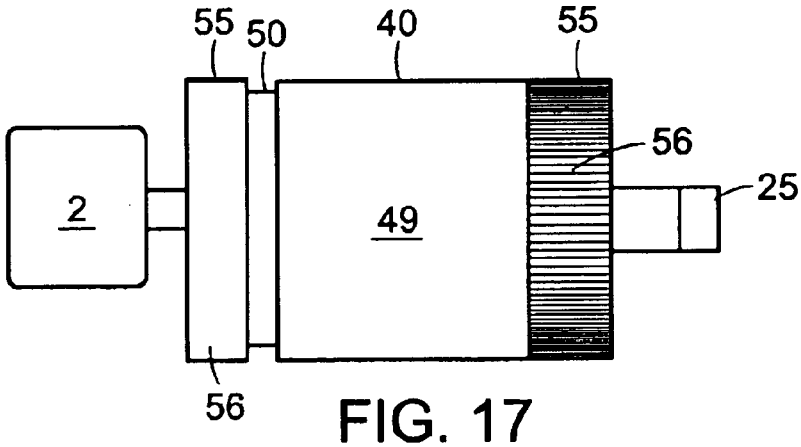
FIG. 17 is a diagramatic side view of the lock body.
Figure 18:
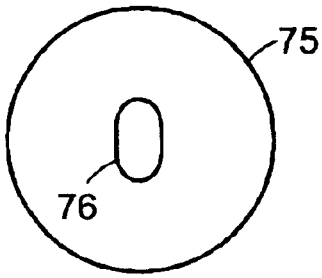
FIG. 18 is a front view of the adjustment spacer.

As stated above the invention is comprised of a lock body 40 containing the lock cylinder 20 with protruding hook element 25. The lock body 40 has an enclosed front end 41 from which a cylindrical side wall 42 extends to an open rear end 43, said front end 41 and rear end 43 defining a lock body longitudinal axis, said front end 41, side wall 42 and rear end 43 defining a hollow lock body interior 44, said lock body 40 being generally cylindrical in shape. The lock body front end 41 has a generally rectangular aperture 46 formed centrally therein. The side wall 42 has an exterior surface 45 and an interior surface 60. For purposes of manufacturing and installation of the lock cylinder within the lock body interior 44, the lock body side wall 42 may be split into two longitudinal halves. The two side wall longitudinal halves may be joined and held in place by a combination of pins 52 and opposing apertures 53 as shown in FIG. 6, and rings 55 (described below).

The side wall exterior surface 45 is divided into four circumferential radial external bands, each external band radially encircling the exterior surface 45. The first exterior band 47 beginning at the lock body front end 41 and extending longitudinally rearwardly a selected distance has threads 48 formed thereon. The fourth exterior band 51 beginning at the lock body rear end 43 and extending longitudinally forwardly a selected distance also has threads 48 formed thereon, and has a radial outer diameter equal to a first exterior band radial outer diameter. The second exterior band 49 beginning at the first exterior band 47 and extending longitudinally rearwardly a selected distance has a smooth surface formed thereon, and has a radial outer diameter greater than the first and fourth exterior band radial outer diameters. The third exterior band 50 beginning at the second exterior band 49 and extending longitudinally to the fourth exterior band 51 has a smooth surface formed thereon, and has a radial outer diameter less than the radial outer diameter of the second external band but greater than the first and fourth exterior band radial outer diameters.

The lock body 40 is further comprised of two identical rings 55, each ring having an outer surface 56 and a threaded inner surface 57, said rings 55 adapted to threadingly engage the first and fourth exterior bands 47, 51. Each ring 55 has a radial outer diameter equal to the radial outer diameter of the second exterior band 49. The ring outer surfaces 56 are nominally smooth. However, for improved gripping purposes the outer surfaces 56 of one or both rings may be knurled or otherwise ridged or channeled for gripping purposes.

The side wall interior surface 60 is divided into two longitudinal portions, a rearward interior surface portion 61 and a forward interior surface portion 62. The rearward interior surface portion 61 is smooth and has a radial inner diameter slightly greater than the radial diameter of the lock cylinder cylindrical body 23. The rearward interior surface 61 has a small circular aperture 69 formed therein, said aperture containing a pin 68 projecting inwardly toward a lock body central longitudinal axis. The pin 68 is adapted to engage the lock cylinder body elongated channel 37, thereby holding the lock cylinder body 23 in position within the lock body interior 44 and preventing the lock cylinder body 23 from moving out of the lock housing 80. The forward interior surface portion 62 contains two radial channels, a forward first radial channel 63 and a rearward second radial channel 64, and also two longitudinal channels, a first longitudinal channel 65 and a second opposite longitudinal channel 66. The radial channels 63, 64 intersect the longitudinal channels 65, 66. The inner diameters of the forward interior surface portion channels 63, 64, 65, 66 are equal to each other, but are greater than the radial inner diameter of the rearward interior surface portion 61. The inner diameters of the forward interior surface portion channels 63, 64, 65, 66 are slightly greater than the locking plate long side edges 33. The inner diameter of the rearward interior surface portion 61 is less than the locking plate long side edges 33. The diameter of the forward interior surface portion 67 between the radial channels 63, 64 is equal to the diameter of the rearward interior surface portion 61. The longitudinal channels 65, 66 extend longitudinally from the lock body front end 41 rearwardly past the radial channels 63, 64 to the interior surface rearward portion 61.

The lock cylinder 20 is positioned within the lock body interior 44 with the front end 25 of the hook element 25 protruding through the lock body front end aperture 46. In the unlocked position, the lock cylinder locking plate 30 is positioned so that the locking plate short side edges 34 are placed within the lock body interior surface longitudinal channels 65, 66. The locking plate 30 is adapted to turn radially 90 degrees when the key 2 is turned to lock the lock cylinder 20. The locking plate 30 is adapted then to slide into one of the forward interior surface portion radial channels 63 or 64. The diameter of the forward interior surface portion 67 between the radial channels 63, 64 and the diameter of the rearward interior surface portion 61 prevents the locking plate 30 from moving rearward. The compression spring 29 about the hook element 25 maintains a rearward pressure on the lock cylinder forward portion 22 and locking plate 30.

The lock body 40 containing the lock cylinder 20 is housed within a cable lock housing 80. The lock housing 80 has an enclosed front end 81 from which a cylindrical side wall 83 extends to an open rear end 82, said front end 81 and rear end 82 defining a lock housing longitudinal axis, said front end 81, side wall 83 and rear end 82 defining a lock housing hollow interior 84, said lock housing body 80 being generally cylindrical in shape. The lock housing front end 81 has a generally circular aperture 89 formed centrally therein. The side wall 83 has a smooth exterior surface 85 and a smooth interior surface 86.

The side wall exterior surface 85 has a rounded, radially protruding, elongated element 90 formed thereon extending longitudinally from the housing rear end 82 to an approximate housing longitudinal midpoint 87. The protruding element 90 has a closed forward end 91, an open rearward end 92, a radially rounded top 93 and a bottom 94 formed from the housing side wall 83, said forward end 91 and rearward end 92 defining a protruding element longitudinal axis, said protruding element longitudinal axis being parallel to the lock housing longitudinal axis. The forward end 91, rearward end 92, top 93 and bottom 94 define a protruding element interior 97. The protruding element 90 is divided longitudinally into a forward section 95 and a rearward section 96. The interior 97 portion of the protruding element forward section 95 is solid. However, an inwardly protruding sprin-loaded ball 88 is embedded in the forward section protruding element bottom 94 projecting inwardly toward a lock housing central longitudinal axis. The spring-loaded ball 88 is adapted to engage the lock body third exterior band 50.

The interior 97 portion of the protruding element rearward section 96 is hollow. The bottom 94 portion of the protruding element rearward section 96 is open. A radial channel 98 is formed within the protruding element rearward section interior 97 portion adjacent the protruding element forward section 95 interior 97 portion. The radial channel 98 has a diameter greater than the diameter of the open rearward end 92 and a bottom 94 opening greater than the bottom 94 opening of the open rear end 92.

Figure 2:
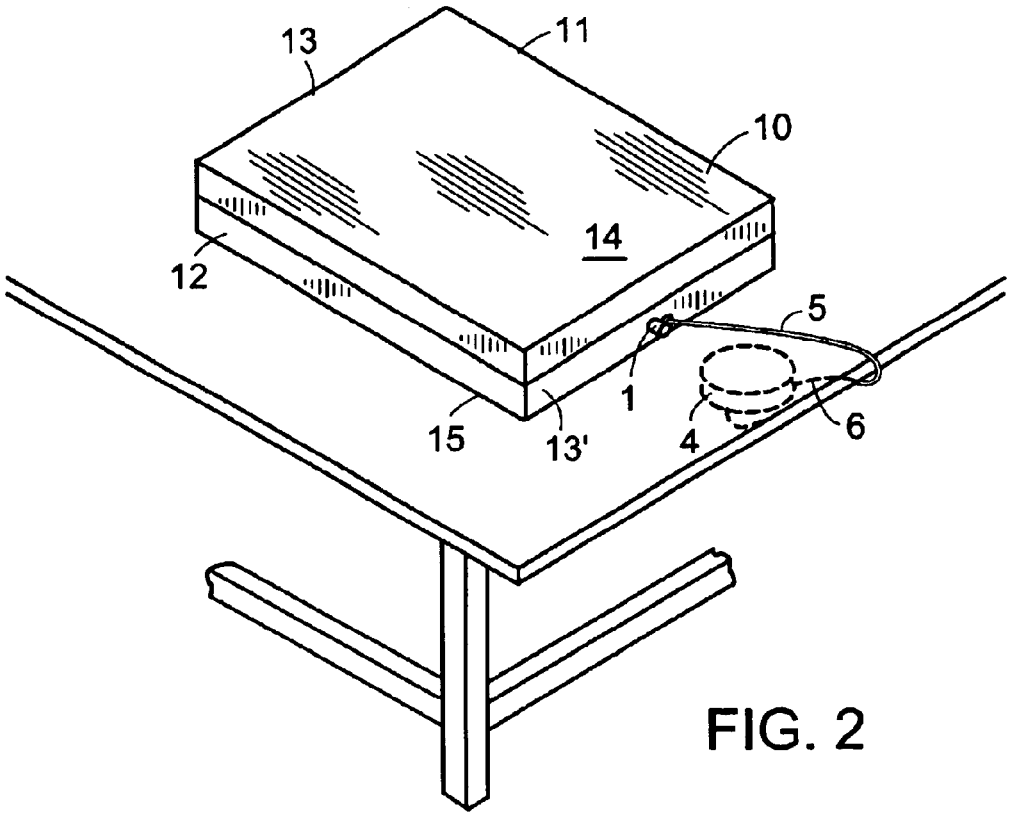
FIG. 2 is a perspective view of the invention, with an office anchor cable, installed on a notebook computer, thereby securing the notebook computer to a work surface.
Figure 3:
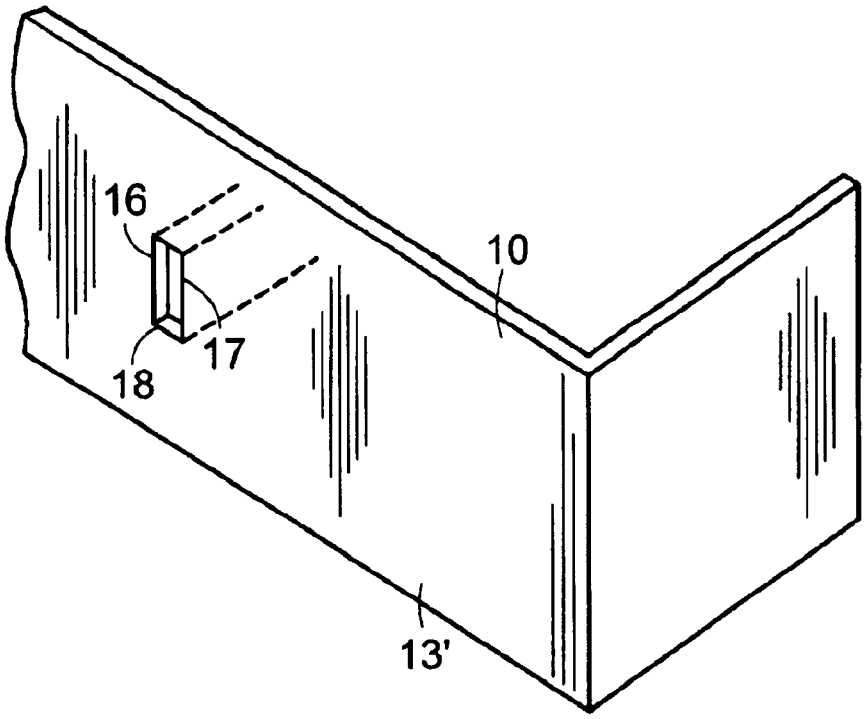
FIG. 3 is a close up perspective view of a computer open security slot.
Figure 4:
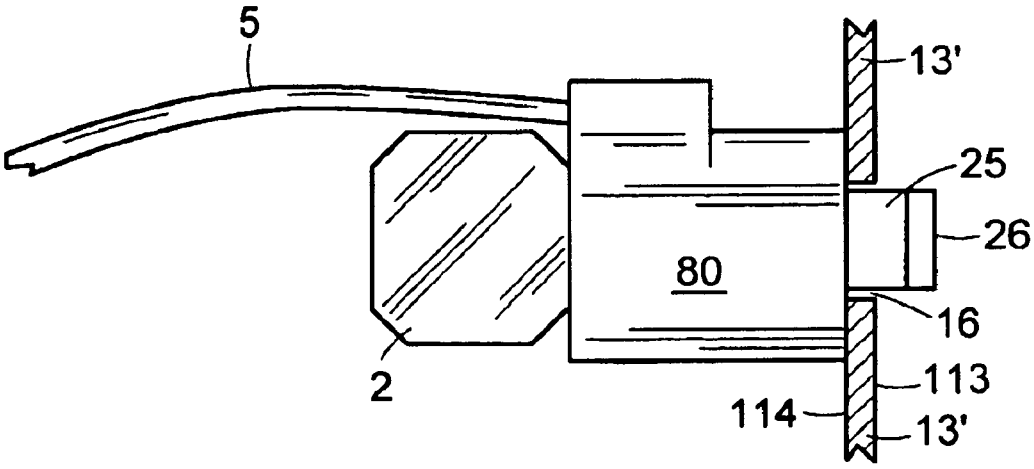
FIG. 4 is a side view of the invention installed in a computer security slot.
Figure 5:
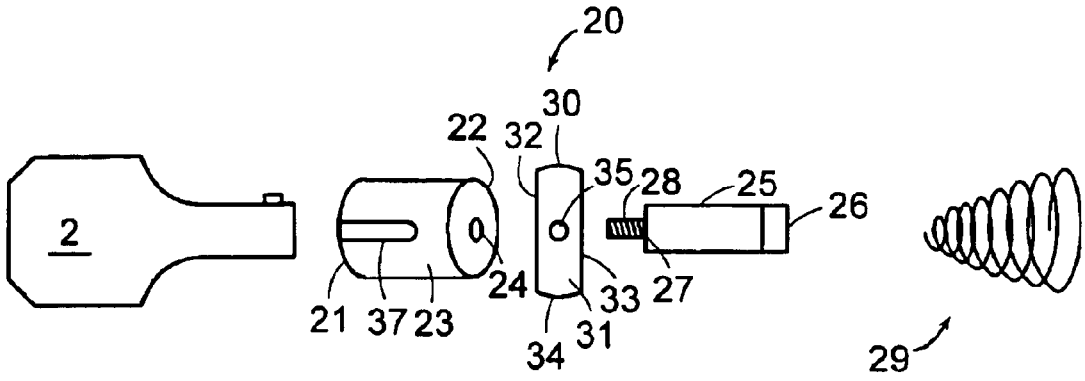
FIG. 5 is a side view, partly exploded, of the lock cylinder.

The cable lock housing 80 and lock body 40 combination is used in conjunction with an anchored locking cable 5. The locking cable 5 has two ends, an anchored end 6 and a holding end 7. As may be seen in FIGS. 1A, 1B and 2, the cable anchored end 6 may terminate in a simple slip knot and wrapped around a secure object such as a table leg 3. The cable anchored end 6 may also be attached to a special adaptor 4 glued to a secure object such as the underside of a desk. Any number of anchor cables having different anchored ends 6 may be used with the present invention. As may be seen additionally from FIGS. 2 and 4, the holding end 7 of the cable is comprised of a cylindrical shank 8 terminating in a disk-like protrusion 9 having a diameter greater than said shank 8. The anchor cable 5 is adapted to being connected to the lock housing 80 by sliding the anchor cable disk 9 into the protruding element radial channel 98 through the protruding element rearward section open bottom 94 and threading the cable shank 8 through the protruding element rearward end 92. The lock body 40 is then slid into the lock housing interior 84 and the cable 5 is secured within the protruding element radial channel 98.

In operation, the anchor cable 5 is installed as described above. The lock body 40 is slid into the lock housing interior 84. The lock cylinder key 2 is held in the unlocked position and the locking plate 30 pushed completely forward wherein the key 2 is turned to turn the locking plate 30 and engage the lock body first radial channel 63. The protruding hook 25 is now at its maximum extension and is easily inserted into the computer open security slot 16. With the hook 25 engaged within the security slot 16, the key 2 is turned back to unlock the lock cylinder 20, and the compression spring 29 pushes the lock cylinder away from the lock body front end 41, thereby drawing the protruding hook front end 26 up against the inside 113 of the computer side wall 13' and pushing the cable lock housing front end 81 against the outside 114 of the computer side wall 13', thereby assuring a snug fit against the security slot 16. The locking plate 30 is pushed back even with the lock body second radial channel 64. The key 2 is again turned to the lock position wherein the locking plate 30 engages the second radial channel 64 and the front end 81 of the cable housing 80 secured against the computer security slot 16. The key 2 is now removed and the computer 10 is thereby secured.

Different computers may have different thicknesses for the wall 13' containing the security slot 16. The present invention provides a means for adjusting the gripping width of the present invention lock assembly 1. The gripping width is defined as the distance between the underside 19 of the protruding hook front end 26 and the cable lock housing front end 81. Ideally, the gripping width should be as close to the width of the computer side wall 13' as possible. Adjustment is provided with the ring 55 in threading engagement with the lock body first exterior band 47. By manipulating this ring 55 the overall longitudinal length of the lock body 40 may be increased or decreased changing the extension of the protruding hook 25 from the lock body front end 41 and through the lock housing front end 81 into the security slot 16, thereby affecting the gripping width of the lock assembly 1.

An adjustment spacer 75 is also provided. The adjustment spacer 75 is a round, flat piece with an elongated aperture 76 formed centrally therein. The spacer 75 has a thickness equal to the thickness of the housing front end 81. The lock body 40 and lock cylinder 20 may be fitted to a computer 10 by removing the lock housing 80 and placing the spacer 75 over the protruding hook 25. The spacer 75 replaces the lock housing 80. The lock body 40 with lock cylinder 20 and spacer 75 are fitted into the security slot 16. After a desired adjustment is made by manipulation of the ring 55 engaged with the first exterior band 47, the spacer 75 is removed and the lock housing 80 is fitted over the lock body 40 for installation on the computer 10.

It is understood that the above-described embodiment is merely illustrative of the application. Other embodiments may be readily devised by those skilled in the art which will embody the principles of the invention and fall within the spirit and scope thereof.

I claim:

1. A locking mechanism with an adjustable gripping width adapted to operate in combination with a computer having a front wall, rear wall, two side walls, a top wall, and a bottom wall, one of said walls having an open security slot formed therein, comprising:

a cable lock housing;

a lock body housed within said cable lock housing, wherein said lock body has an enclosed front end from which a cylindrical side wall extends to an open rear end, said front end and rear end defining a lock body longitudinal axis, said front end, side wall and rear end defining a hollow lock body interior, said lock body being generally cylindrical in shape, said lock body front end having a generally rectangular aperture formed centrally therein, said side wall having an exterior surface and an interior surface;

wherein the side wall exterior surface is divided into four circumferential radial external bands, each first, second, third and fourth external band radially encircling the exterior surface, said first exterior band beginning at the lock body front end and extending longitudinally rearwardly a selected distance, said first exterior band being threaded, said fourth exterior band beginning at the lock body rear end and extending longitudinally forwardly a selected distance, said fourth exterior band being threaded, said fourth exterior band having a radial outer diameter equal to a first exterior band radial outer diameter, said second exterior band beginning at the first exterior band and extending longitudinally rearwardly a selected distance, said second exterior band having a smooth surface formed thereon and a radial outer diameter greater than the first and fourth exterior band radial outer diameters, said third exterior band beginning at the second exterior band and extending longitudinally to the fourth exterior band, said third exterior band having a smooth surface formed thereon and a radial outer diameter less than the radial outer diameter of the second external band and greater than the first and fourth exterior band radial outer diameters;

wherein the side wall interior surface is divided into two longitudinal portions, a rearward interior surface portion and a forward interior surface portion, said rearward interior surface portion being smooth and having a radial inner diameter greater than the radial diameter of the lock cylinder cylindrical body, said rearward interior surface has a circular aperture formed therein, said aperture containing a pin projecting inwardly toward a lock body central longitudinal axis, said pin adapted to engage the lock cylinder body elongated channel, said forward interior surface portion containing two radial channels, a forward first radial channel, a rearward second radial channel, a first longitudinal channel and a second opposite longitudinal channel, said radial channels intersecting the longitudinal channels, said forward interior surface portion channels having diameters equal to each other, and diameters greater than the radial inner diameter of the rearward interior surface portion, said forward interior surface portion channel inner diameters being greater than the locking plate long side edges, said inner diameter of the rearward interior surface portion being less than the locking plate long side edges, said forward interior surface portion having a diameter between the radial channels equal to the diameter of the rearward interior surface portion, said longitudinal channels extending longitudinally from the lock body front end rearwardly past the radial channels to the interior surface rearward portion;

a lock cylinder contained within said lock body, wherein said lock cylinder is comprised of:

a key operated lock adapted to hold a key rotational turn at either zero degrees or ninety degrees, said lock cylinder has a rear portion adapted to receive a key, a forward portion and a cylindrical body defined by said rear and forward portions, said rear and forward portions defining a lock cylinder longitudinal axis, said lock cylinder body having an elongated channel formed therein, beginning at the lock cylinder rear portion and extending forwardly a desired distance, said channel having a longitudinal axis coincident with the lock cylinder longitudinal axis, said lock cylinder forward portion having a threaded central aperture formed therein;

a generally flat and generally rectangular locking plate fixedly attached to the lock cylinder forward portion, said locking plate having a flat plane parallel to a radial plane of the lock cylinder cylindrical body, said locking plate having a forward surface, a rearward surface, two parallel long side edges, two parallel short side edges, and a central aperture corresponding to the lock cylinder forward portion aperture, said locking plate rearward surface being fixedly attached to the lock cylinder forward portion, said locking plate short side edges defining a locking plate longitudinal axis parallel to the locking plate long side edges and transverse to the longitudinal axis of the lock cylinder, said locking plate long side edges exceeding in length a lock cylinder cylindrical body radial diameter, said lock cylinder adapted to cause a direct corresponding turn of the locking plate longitudinal axis about the locking plate central aperture as the key is moved to and from zero degrees through ninety degrees;

a protruding hook element attached to the lock cylinder forward portion, said hook element having a front end and a rear end terminating in a threaded element extending rearwardly from the hook element rear end, said hook element front end being bent at an angle thereby forming a hook, said hook element threaded element adapted to threadingly engage the lock cylinder forward portion central threaded aperture through the locking plate central aperture; and a compression spring fitted over the hook element;

an anchored locking cable removably attached to the cable lock housing.

2. A locking mechanism as recited in claim 1, further comprising:

two identical rings, each ring having an outer surface and a threaded inner surface, said rings adapted to threadingly engage the lock body side wall exterior surface first and fourth exterior bands, each ring having a radial outer diameter equal to the radial outer diameter of the second exterior band.

3. A locking mechanism as recited in claim 2, wherein:

the cable lock housing has an enclosed front end from which a cylindrical side wall extends to an open rear end, said front end and rear end defining a lock housing longitudinal axis, said front end, side wall and rear end defining a lock housing hollow interior, said lock housing body being generally cylindrical in shape, said lock housing front end having a generally circular aperture formed centrally therein, said side wall having an exterior surface and an interior surface, said side wall exterior surface having a rounded, radially protruding, elongated element formed thereon extending longitudinally from the housing rear end to an approximate housing longitudinal midpoint, said protruding, elongated element having a closed forward end, an open rearward end, a radially rounded top and a bottom formed from the housing side wall, said forward end and rearward end defining a protruding element longitudinal axis, said protruding element longitudinal axis being parallel to the lock housing longitudinal axis, said forward end, rearward end, top and bottom defining a protruding element interior, said protruding element being divided longitudinally into a forward section and a rearward section, said forward section having an inwardly protruding spring-loaded ball embedded in the forward section protruding element bottom projecting inwardly toward a lock housing central longitudinal axis, said protruding spring-loaded ball adapted to engage the lock body third exterior band, said protruding element rearward section having a hollow interior, said bottom portion of the protruding element rearward section being open, said protruding element rearward section interior having a radial channel formed within a portion adjacent the protruding element forward section interior portion, said radial channel having a diameter greater than a diameter of the open rearward end, and a bottom opening greater than a bottom opening of the open rear end.

4. A locking mechanism as recited in claim 3, wherein:

the anchored locking cable has two ends, an anchored end and a holding end, said cable holding end being comprised of a cylindrical shank terminating in a disk having a diameter greater than said shank, said anchored locking cable adapted to be connected to the lock housing by insertion of the anchor cable disk into the protruding element radial channel through the protruding element rearward section open bottom and threading the cable shank through the protruding element rearward end, said lock body inserted into the lock housing interior secures the cable within the protruding element radial channel.

5. A locking mechanism as recited in claim 4, further comprising:

an adjustment spacer, said adjustment spacer being a round, flat piece with an elongated aperture formed centrally therein, said spacer having a thickness equal to a thickness of the housing front end, said spacer adapted to placement over the protruding hook.

6. A locking mechanism as recited in claim 5, wherein:

the locking plate is adapted to interact with grooves within the cylindrical assembly to position and hold the protruding hook longitudinally, wherein the lock cylinder is positioned within the lock body interior with the front end of the hook element protruding through the lock body front end aperture, wherein in an unlocked position, the lock cylinder locking plate short side edges are placed within the lock body interior surface longitudinal channels and said locking plate is adapted to be pushed forward, wherein the locking plate is adapted to turn radially ninety degrees when the key is turned to lock the lock cylinder, said locking plate being adapted to slide into one of the forward interior surface portion radial channels, said compression spring about the hook element adapted to maintain a rearward pressure on the lock cylinder forward portion and locking plate.

7. A locking mechanism as recited in claim 6, wherein:

the lock body side wall is be split into two longitudinal halves, said side wall longitudinal halves being joined and held in place by a plurality of pins and said rings.

8. A locking mechanism as recited in claim 7, wherein:

said ring outer surfaces are knurled.

9. A locking mechanism as recited in claim 7, wherein:

said ring outer surfaces are ridged.

10. A locking mechanism as recited in claim 7, wherein:

said ring outer surfaces are channeled.

* * * * *